US006110002A

United States Patent [19]

Langton

[11] Patent Number: 6,110,002

[45] **Date of Patent: *Aug. 29, 2000**

[54] POSEABLE FIGURE AND SPINE SYSTEM FOR THEREIN

[76] Inventor: Michael Langton, P.O. Box 1122, North Hampton, N.H. 03862

[ * ] Notice: This patent issued on a continued prosecution application filed under 37 CFR 1.53(d), and is subject to the twenty year patent term provisions of 35 U.S.C. 154(a)(2).

[21] Appl. No.: 08/900,901

[22] Filed: Jul. 25, 1997

[51] Int. Cl.[7] ..... A63H 3/36

[52] U.S. Cl. ..... 446/375; 446/373; 446/380; 446/381; 446/383

[58] Field of Search ..... 446/97, 373, 374, 446/375, 376, 377, 379, 380, 381, 382, 383, 378

[56] References Cited

U.S. PATENT DOCUMENTS

| | | | |
|---|---|---|---|
| 703,899 | 7/1902 | Debes | 446/383 |
| 807,664 | 12/1905 | Debes | 446/383 |
| 1,436,258 | 11/1922 | Holland | 446/381 |
| 1,441,164 | 1/1923 | Murray | 446/381 |
| 2,129,421 | 9/1938 | Hales | 446/375 |
| 2,904,930 | 9/1959 | Baggott et al. | 446/378 |
| 3,266,059 | 8/1966 | Stelle | 446/374 |
| 3,557,471 | 1/1971 | Payne et al. | 446/375 |
| 3,628,282 | 12/1971 | Johnson et al. | 46/161 |
| 3,634,966 | 1/1972 | Ostrander | 46/161 |
| 3,862,513 | 1/1975 | Isaacson et al. | 46/119 |
| 3,921,332 | 11/1975 | Terzian et al. | 46/161 |
| 3,940,880 | 3/1976 | Kaelin et al. | 46/161 |
| 3,952,449 | 4/1976 | Terzian | 46/161 |
| 3,988,855 | 11/1976 | Crabtree et al. | 46/161 |
| 4,069,613 | 1/1978 | Lemelson et al. | 46/120 |
| 4,135,327 | 1/1979 | Sapkus et al. | 46/161 |
| 4,274,224 | 6/1981 | Pugh et al. | 46/161 |
| 4,571,209 | 2/1986 | Manning et al. | 446/375 |
| 4,669,998 | 6/1987 | Amici et al. | 446/383 |
| 4,932,919 | 6/1990 | Shapero | 446/374 |
| 4,968,282 | 11/1990 | Robson et al. | 446/376 |
| 5,017,173 | 5/1991 | Shapero et al. | 446/374 |
| 5,486,127 | 1/1996 | Wolfe | 446/97 |
| 5,531,625 | 7/1996 | Zhong | 446/120 |
| 5,620,352 | 4/1997 | Tzong | 446/383 |
| 5,752,869 | 5/1998 | Huff | 446/104 |

FOREIGN PATENT DOCUMENTS

| | | | |
|---|---|---|---|
| 546471 | 10/1959 | Belgium | 446/373 |
| 123892 | 1/1959 | U.S.S.R. | 446/376 |
| 439697 | 12/1935 | United Kingdom | 446/376 |
| 2197800 | 6/1988 | United Kingdom | 446/373 |

*Primary Examiner*—Robert A. Hafer
*Assistant Examiner*—Jeffrey D. Carlson
*Attorney, Agent, or Firm*—Bourque & Associates, P.A.

[57] ABSTRACT

A poseable figure has a spine system that is capable of a wide range of life-like movement and capable of being positioned and maintained in numerous life-like poses. The spine system includes of plurality of mating spine segments engaged, in a friction fit, with one another such that the mating spine segments swivel with respect to one another. A soft body portion, such as a foam, is disposed around the spine system to simulate the flesh of the figure and to allow the spine system to be moved into a wide range of positions. In one embodiment, first and second appendage connectors couple a first and second pair of appendages, such as arms and legs, to the spine system such that the appendages swivel with respect to the spine system and can be moved and held in numerous positions. A resilient member preferably extends through the mating spine segments and engages with the head of the figure to hold the head in swiveling engagement with a neck segment coupled to the spine system. In addition to human figures, the spine system can be used in animals and other living or non-living articulated figures.

17 Claims, 7 Drawing Sheets

POSEABLE FIGURE AND SPINE SYSTEM FOR THEREIN

FIELD OF THE INVENTION

The present invention relates to poseable figures and in particular, a poseable figure having a novel spine system capable of being placed into numerous life-like poses.

BACKGROUND OF THE INVENTION

Articulated or poseable figures, such as dolls, are commonly used by children as toys and also collected by both children and adults. A common poseable figure has a human form including a torso, a head and a number of limbs or appendages that are moveable with respect to the torso. The shape or form of the figure is typically provided by molding the desired shape or form into the torso portion which is commonly made of a rigid material such as plastic. Ball and socket type joints are typically used to connect the appendages to the rigid torso.

Existing poseable figures, however, are not capable of accurately simulating life-like movement and maintaining life-like poses. In particular, the rigid torsos used in existing poseable figures are not capable of being moved in a way that simulates the movements and positions made possible by the human spine and torso. As a result, existing poseable figures cannot be used to simulate complex and subtle human movement and poses, for example, during athletic events. The ball and socket type joints used in existing poseable figures also do not provide the range of motion necessary for the figure to move in a way that simulates human movement. Typical ball and socket joints are either difficult to position because the joint is too tight or unable to remain in position because the joint is too loose. In addition, most dolls and poseable figures are not capable of having various body shapes and sizes due in part to the hard, rigid material of the figure.

Accordingly, a need exists for a poseable figure having a spine system capable of a degree of movement that simulates lifelike movement, that can be positioned in and maintain a variety of life-like poses, and that has a pliable body portion that can be made in various shapes and sizes. What is also needed is a poseable figure having a pliable body portion that moves with the spine system and conforms to the human like movement and poses. A need also exists for an improved ball and socket joint used to couple appendages to a spine system of a poseable figure such that the appendages have a wide range of movement and will maintain various positions without suffering deterioration of integrity over time.

SUMMARY OF THE INVENTION

The present invention features a poseable figure comprising a spine system including a plurality of mating spine segments. Each of the plurality of mating spine segments are engaged, in a friction fit, with an adjacent mating spine segment such that each of the mating spine segments swivel with respect to one another. A soft body portion is formed around the spine system to simulate the flesh of the poseable figure. A first appendage connector is coupled to the spine system proximate a first spine end, and a first pair of appendages are coupled to the first appendage connector such that the first pair of appendages swivel with respect to the first appendage connector. A second appendage connector is coupled to the spine system proximate a second spine end, and a second pair of appendages are coupled to the second appendage connector such that the second pair of appendages swivel with respect to the second appendage connector. A head is coupled to the spine system at the first spine end.

According to the preferred embodiment, the poseable figure simulates a human or other type of animal. The spine system having the mating spine segments engaged in a friction fit allows the poseable figure to move and to pose in a life-like manner that simulates the movement and poses of the human or animal.

The poseable figure may include a resilient member, such as an elastic member or a metal spring, extending through the plurality of mating spine segments from the first spine end to the second spine end of the spine system. A neck segment is preferably coupled to one of the plurality of mating spine segments at the first spine end, and the head is coupled to the resilient member and engaged with the neck segment such that the head swivels with respect to the neck segment.

The first and second appendage connectors each preferably include a pin extending through one of the mating spine segments and a pair of ball shaped appendage engaging members disposed at respective ends of the pin. Each of the appendages includes a socket that receives a respective one of the pair of ball shaped appendage engaging members. A pressurized insert, e.g., made of silicone rubber material, is disposed between each ball shaped appendage engaging member and each respective socket of the appendage. The pressurized insert is preferably made by providing liquid silicone rubber material between a socket of an appendage, and a ball shaped appendage engaging member, and subjecting the silicone rubber material to a pressurized environment while curing. The present invention contemplates using this pressurized insert and method with any type of joint in any type of application.

According to the preferred embodiment of the spine system, each of the plurality of mating spine segments includes a cup-shaped portion having a concave receiving region and a ball-shaped portion extending from the cup-shaped portion. The ball-shaped portion of one of the mating spine segments is received, in a friction fit, in a concave receiving region of a mating spine segment such that the plurality of mating spine segments swivel with respect to each other. The mating cup-shaped portions and the ball-shaped portions swivel with respect to one another in a manner that provides a range of movement of the spine system that simulates the range of movement of the human or animal spine. The spine system preferably includes at least three mating spine segments.

DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 1:
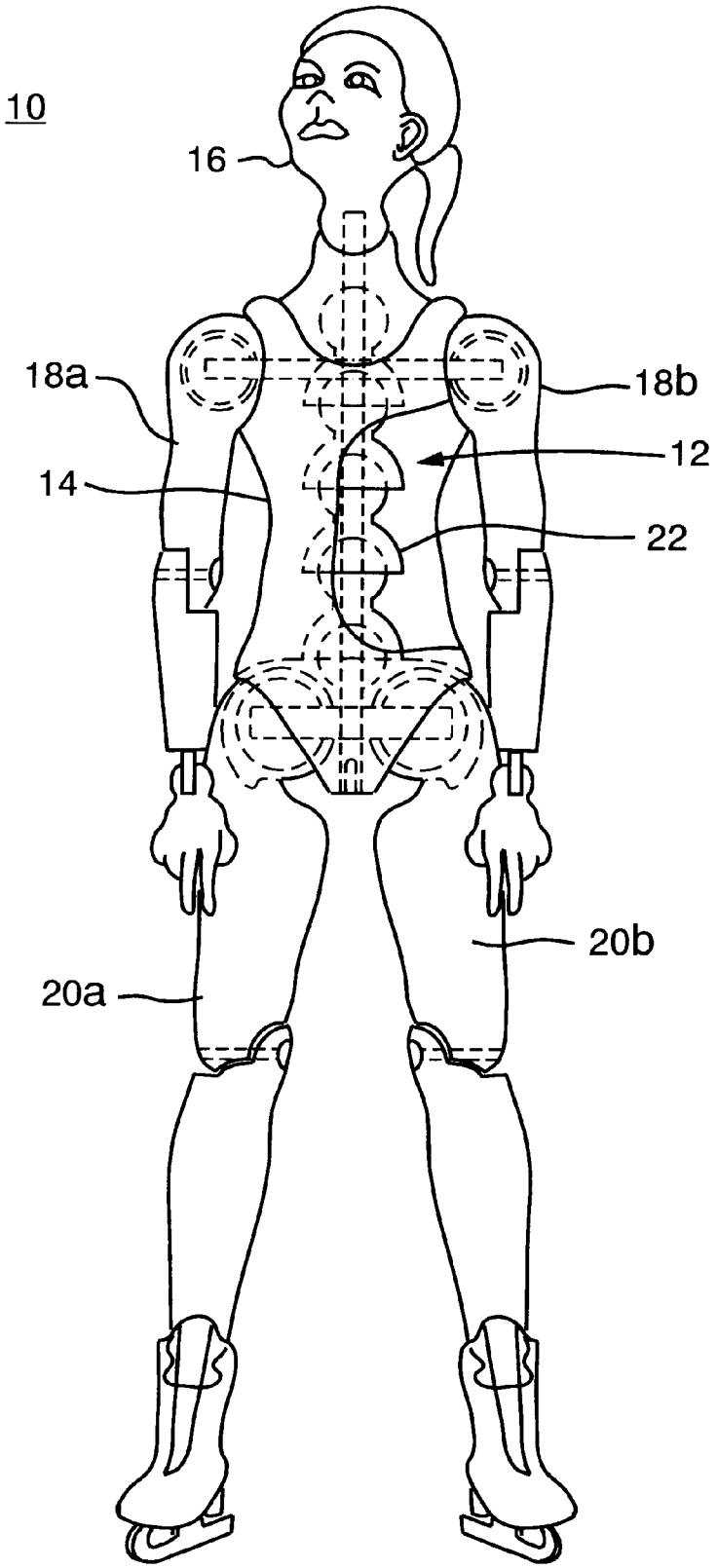
FIG. 1 is a front schematic view of the poseable figure according to the present invention.

A poseable FIG. 10, FIG. 1, according to the present invention includes a spine system 12 and a soft body portion 14 disposed around the spine system 12 to simulate the flesh of the poseable FIG. 10. The spine system 12 includes a plurality of mating spine segments 22 that are engaged with one another, in a friction fit, such that the spine system 12 can be bent, twisted and otherwise positioned into various poses in a life-like manner and remains positioned in the desired pose. The soft body portion 14 moves with the spine system 12 to simulate a variety of life-like poses and shapes.

According to the exemplary embodiment, the poseable FIG. 10 has a human form and likeness and includes a head 16, a first pair of appendages (arms) 18*a,* 18*b* and a second pair of appendages (legs) 20*a,* 20*b* coupled to the spine system 12. However, the present invention contemplates using the spine system 12 with poseable figures having other types of animal or non-animal forms.

Figure 2:
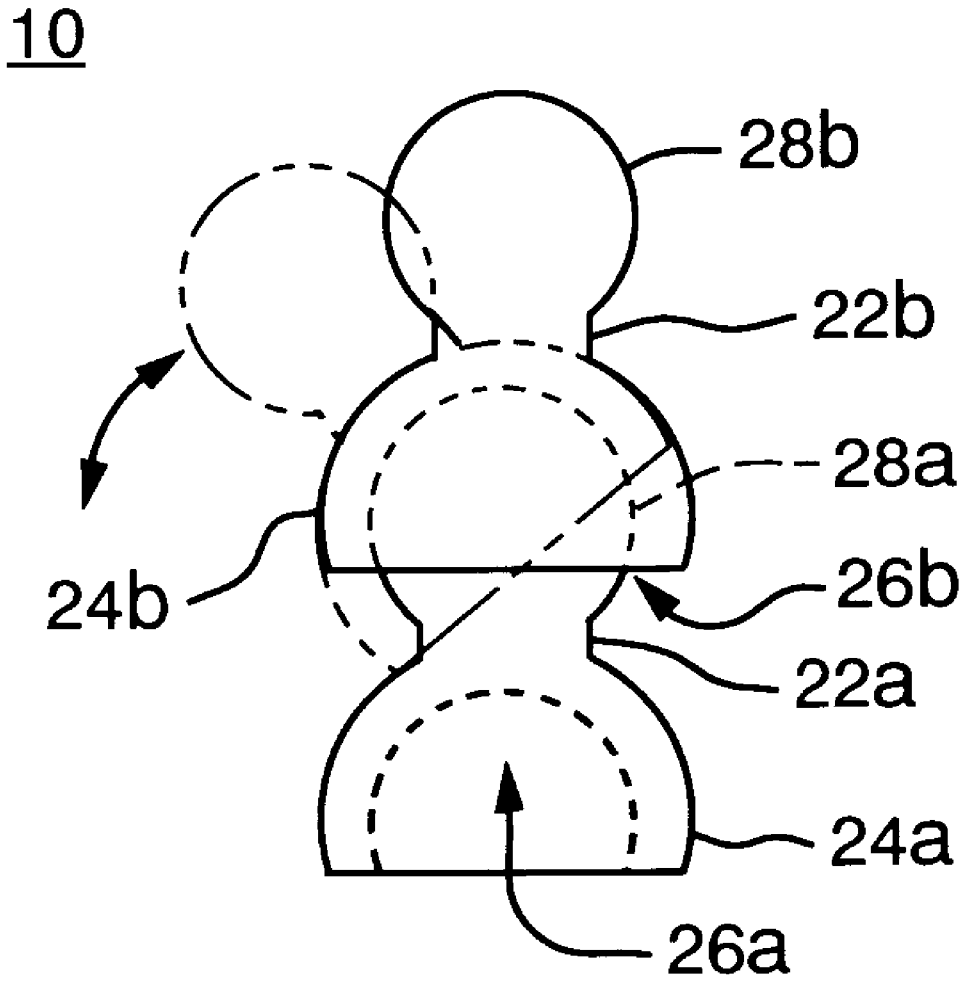
FIG. 2 is a schematic view of two mating spine segments used in the poseable figure according to the present invention.

According to the preferred embodiment, each mating spine segment 22*a,* 22*b,* FIG. 2, includes a first portion 24*a,* 24*b* preferably defined as a cup shape and having a concave receiving region 26*a,* 26*b.* The segment 22 also includes a ball shaped portion 28*a,* 28*b* extending from the cup shaped portion 24*a,* 24*b.* The ball shaped portion 28*a* of one of the mating spine segments 22*a* is received, in a friction fit, within the concave receiving region 26*b* of a mating spine segment 22*b.* The mating spine segments 22*a,* 22*b* are thus capable of swiveling with respect to one another with a significant range of motion. The friction fit between the mating spine segments 22*a,* 22*b,* achieved by proper dimensioning of the parts, causes the mating spine segments 22*a,* 22*b* to be moved to a desired position and to remain in the desired position. In one example, the mating spine segments 22*a,* 22*b* are made of a molded plastic or other suitable material that produces a friction fit strong enough to counteract the memory of the soft foam material used for the body portion 14. Alternatively, the mating spine segments may also be machined.

Figure 3:
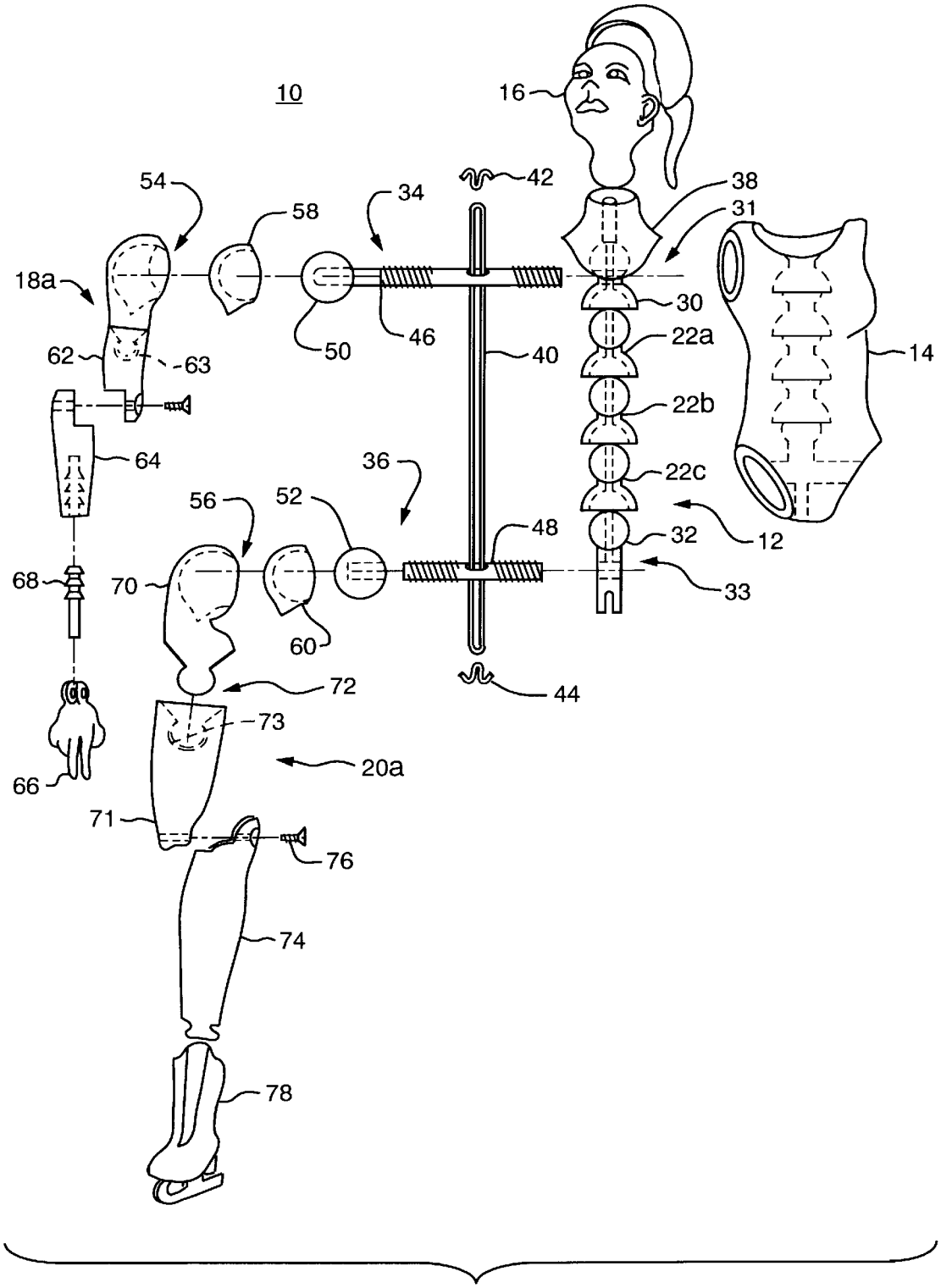
FIG. 3 is an exploded schematic view of a poseable figure having the spine system according to the present invention.

The preferred embodiment of the spine system 12, FIG. 3, includes a first end spine segment 30 coupled to one of the mating spine segments 22*a* at a first spine end 31, and a second end spine segment 32 coupled to one of the mating spine segments 22*c* at the second spine end 33. A first appendage connector 34 couples the first pair of appendages 18*a,* 18*b* to the first end spine segment 30, and a second appendage connector 36 couples the second pair of appendages 20*a,* 20*b* to the second end spine segment 32 (for the sake of clarity, only one of the first and second pairs of appendages are shown in FIG. 3). A neck segment 38 is preferably coupled to the first end spine segment 30 and receives the head 16.

An elastic member 40 or other similar resilient device preferably extends through the mating spine segments 22*a*–22*c,* 30, 32, through the first and second appendage connectors 34, 36, and through the neck segment 38. The elastic member 40 is coupled to the head 16, using for example, a hook 42, such that the head 16 is engaged with the neck segment 38 and is capable of swiveling with respect to the neck segment 38. The elastic member 40 is also coupled to the second end spine segment 32, e.g., with a hook 44. The elastic member 40 thereby helps to maintain the spine system 12, first and second appendage connectors 34, 36, neck segment 38, and head 16 into engagement while allowing movement and positioning of the spine segment 12. Alternatively, a ⅛ in. metal spring can be used in place of the elastic member 40.

The preferred embodiment of the first and second appendage connectors 34, 36 includes a pin or rod 46, 48 that extends through an aperture in the respective first end spine segment 30 and second end spine segment 32. Each of the pins 46, 48 include a pair of ball shaped appendage engaging members 50, 52 at respective ends of the first and second pins 46, 48 (only one of the pair is shown in FIG. 3, for the sake of clarity). In one example, the ball shaped engaging members 50, 52 are cast from a resin material, such as a polyurethane resin. In one example, the first and second pins 46, 48 include threaded bolts on which the ball shaped portions 50, 52 are threadably engaged. In another example, the pins or rods 46, 48 have a hexagonal or other similar shape and are glued to the ball shaped engaging members 50, 52 such that the ball shaped engaging members 50, 52 are prevented from rotating with respect to the pins or rods 46, 48.

Each of the appendages 18*a,* 20*a* include a socket 54, 56 that receives a respective ball shaped engaging member 50, 52 such that the appendages 18*a,* 20*a* pivot with respect to the first and second appendage connectors 34, 36. A pressurized insert 58, 60, e.g. made of a silicone rubber or other compressible material, is disposed between the ball shaped appendage engaging members 50, 52 and the respective sockets 54, 56 of the appendages 18*a,* 20*a,* for applying pressure against the ball shaped appendage engaging member 50, 52.

According to one method, the pressurized inserts 58, 60 are formed from room temperature vulcanized (RTV) silicone. The ball shaped engaging members 50, 52 are placed into the respective sockets 54, 56 and the RTV silicone is pumped between the socket 54, 56 and the ball shaped engaging members 50, 52. The liquid silicone rubber preferably has a viscosity sufficient to flow into the socket while maintaining the capture of air bubbles during curing. The joint and the RTV silicone are then subjected to pressure, for example, in a range of about 50 to 150 psi, such that the air bubbles in the silicone rubber are reduced in size while the silicone rubber sets or cures. The silicone rubber material may be heated (e.g., at about 120° F.) while pressurized to speed up the curing process and prevent bubbles from escaping.

Upon removing the pressure, the bubbles within the RTV silicone or other similar compressible material expand to form pressurized inserts 58, 60 that provide maximum contact between the ball shaped engaging members 50, 52 and the respective sockets 54, 56. The silicone material provides lubrication for the ball shaped engaging members 50, 52 to move freely within the sockets 54, 56 such that the appendages 18*a,* 20*a* are capable of swiveling into a wide range of positions. The pressure applied by the inserts 58, 60 against the ball shaped engaging members 50, 52 and the sockets 54, 56 maintains the respective appendages 18*a,* 20*a* in each position such that the poseable FIG. 10 can hold numerous life-like poses.

The present invention contemplates using this method of forming the sleeves with any type of ball and socket joint or other similar types of joints or bearings used to couple structural members in any application. Either the structural member having the ball or the structural member having the socket can be moved to effectively position the members. According to one alternative, the spine system 12 can be formed with multiple ball and socket joints having a pressurized insert made according to the above method.

In the exemplary embodiment, each of the appendages 18*a,* 20*a* include multiple pieces coupled together with pivot and/or swivel joints. In the exemplary embodiment, each of the first pair of appendages (or arms) 18*a* include at least an upper arm portion 62 pivotally coupled to a lower arm portion 64. A hand 66 can be pivotally coupled to the lower arm portion 64 with a wrist pin 68. The upper arm portion 62 can be formed in two pieces allowing additional movement of the arm about a longitudinal axis of the arm. The two pieces of the upper arm portion can be coupled with a ball and socket/pressurized insert assembly 63, as described above, or with other types of joints. The present invention contemplates additional segments or other types of joints in each of the first pair of appendages 18.

Each of the second pair of appendages 20 includes an upper leg portion preferably formed in two pieces 70, 71 with an upper leg joint 72 that allows relative rotation of the first and second upper leg portion pieces 70, 71 generally along a longitudinal axis extending through the upper leg portion pieces 70, 71. The upper leg joint 72 is preferably a ball and socket joint including a pressurized insert 73, as described above. The first upper leg portion piece 70 is molded and then used to mold the second upper portion piece 71 to form the mating ball and socket joint. A lower leg portion 74 is pivotally coupled to the second upper leg portion piece 71, for example, with a pin 76. A foot portion 78, such as a boot, is preferably cast around the lower leg portion 74, allowing the foot portion 78 to move relative to the lower leg portion 74.

The soft body portion 14 which covers the spine system 12 is preferably made of a foam or similar soft, pliable material that can be cast or sewn over the spine system 12. In one example, the foam is a generic low density flexible water-blown polyurethane foam having a density in a range of about 2 to 6 lbs./ft.$^3$. The foam can be cast over the spine system 12 in various forms and body shapes. The foam allows the spine system 12 to move with a wide range of movement into the various positions in a life-like manner. Alternatively, the present invention contemplates a soft body portion 14 made of other types of foam capable of moving with the spine system 12. The soft body portion 14 can thereby be formed into any body type having any size, shape and figure. The soft body portion 14 may be the final body covering (imitating clothing) or may be covered by separate items of clothing.

According to the exemplary embodiment, the poseable figure 12, FIGS. 4A–4E, can be moved and set in various poses simulating the human form. Although the poses shown are of a figure skater, the present invention contemplates any type of athletic or non-athletic poses. In one pose, the spine system 12, FIG. 4A, can be bent slightly to simulate an arched back while the figure is standing upright. The spine system 12 and pliable body portion 14 allow this subtle aspect of the human form to be easily and accurately simulated.

Figure 4A:
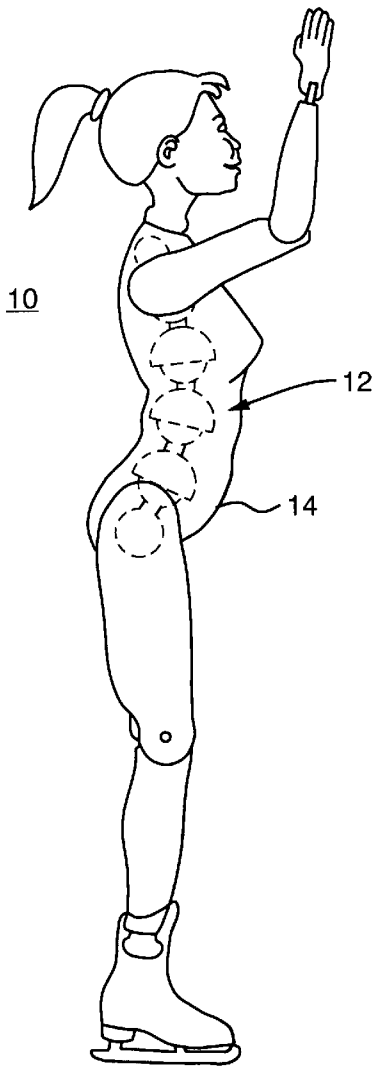
FIGS. 4A–4E are views illustrating the range of motion and exemplary poses of the poseable figure.
Figure 4B:
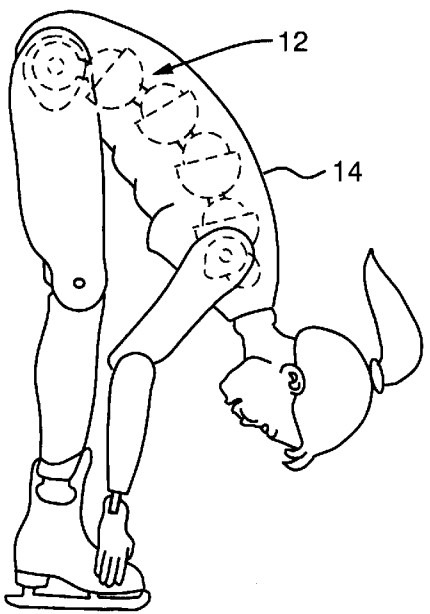

In another pose, the spine system 12, FIG. 4B, and the soft body portion 14 allow the poseable FIG. 10 to be bent over forward. In this pose, the spine system 12 forms a slight bend simulating the way in which a human back would bend when the individual is reaching down to touch her toes.

Figure 4C:
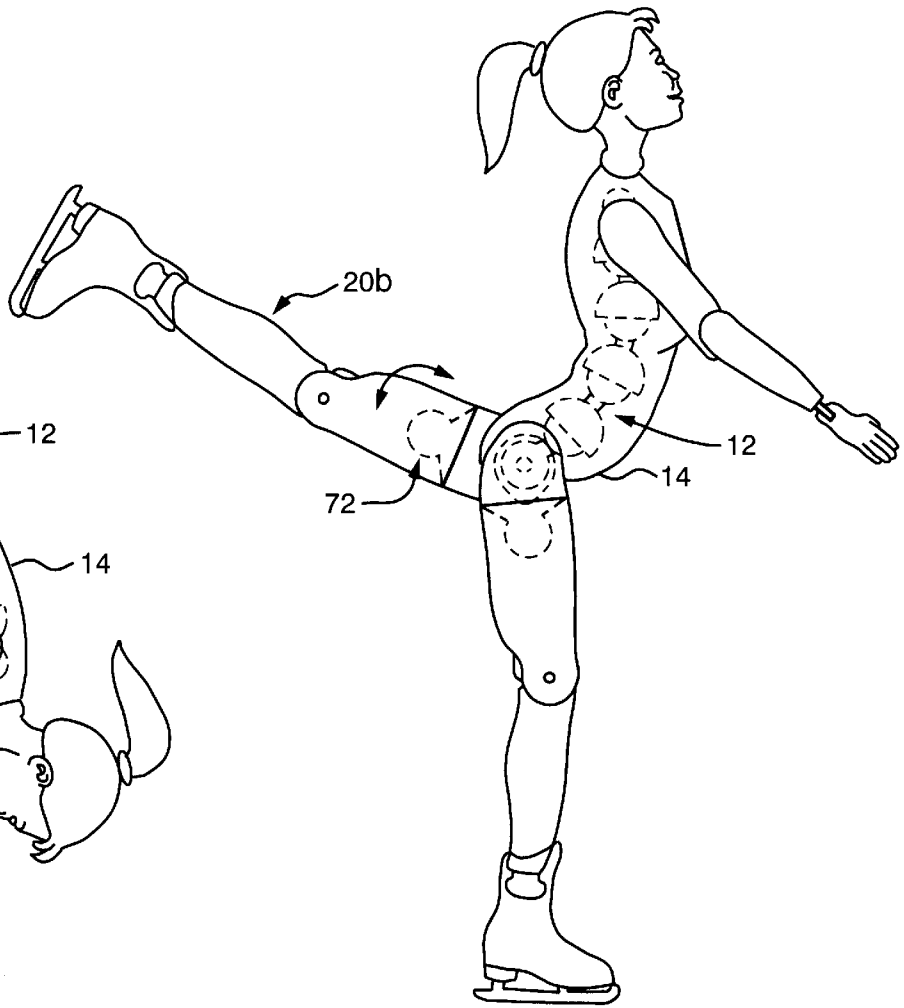

In another pose, the spine system 12, FIG. 4C, is given a more pronounced arch while one or more of the appendages 20*b,* 18*a* are extended and held in the extended position. In the preferred embodiment, the upper leg joint 72 allows the appendage 20*b* to rotate generally about the axis extending through the appendage 20*b*. This rotation of the appendage 20*b* allows the lifelike simulation of the leg of a human, such as a figure skater.

Figure 4E:
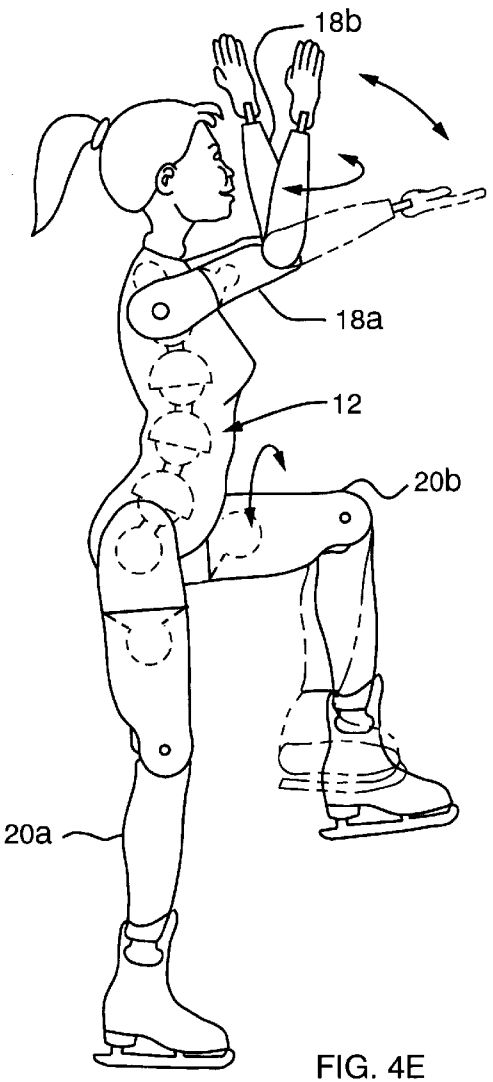
Figure 4D:
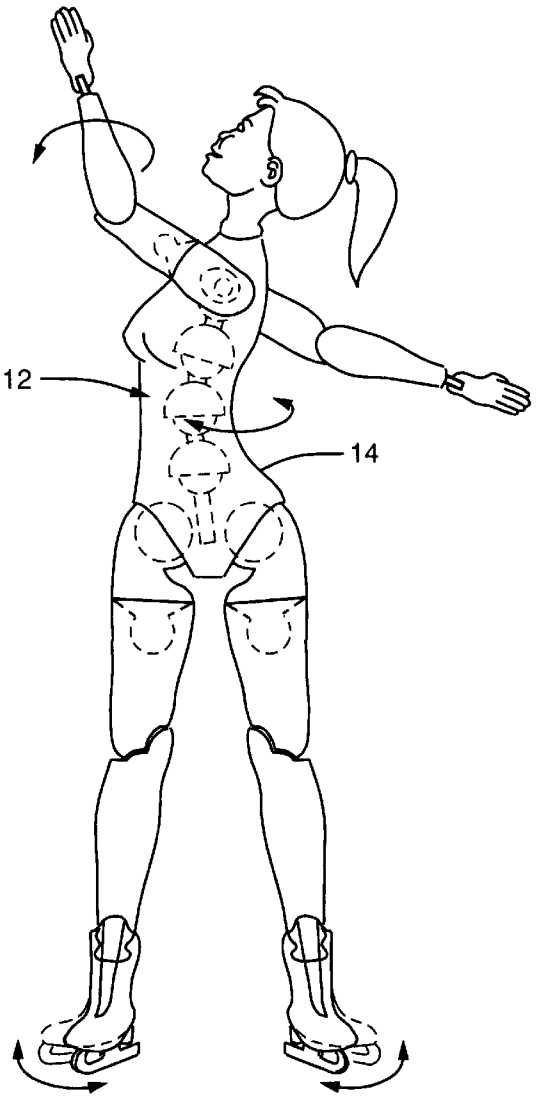

According to a further pose, the spine system 12, FIG. 4D, can be twisted and held by a friction fit in a twisted position. The twisted spine system 12 and soft body portion 14 thereby simulate the turning or rotating of the upper torso of the human body.

According to various other poses, the appendages 18*a,* 18*b,* 20*a,* 20*b,* FIG. 4E, can be pivoted, rotated, and moved into numerous positions to simulate human activities. In addition to those poses shown, the present invention contemplates numerous other movements and poses by positioning the spine system 12 and/or one or more appendages 18*a,* 18*b,* 20*a,* 20*b*. Accordingly, the spine system 12 and soft body portion 14 allow the poseable FIG. 10 to have both a wide range of motion with numerous possible poses and to be capable of subtle poses that accurately simulate human form and movement.

Figure 5:
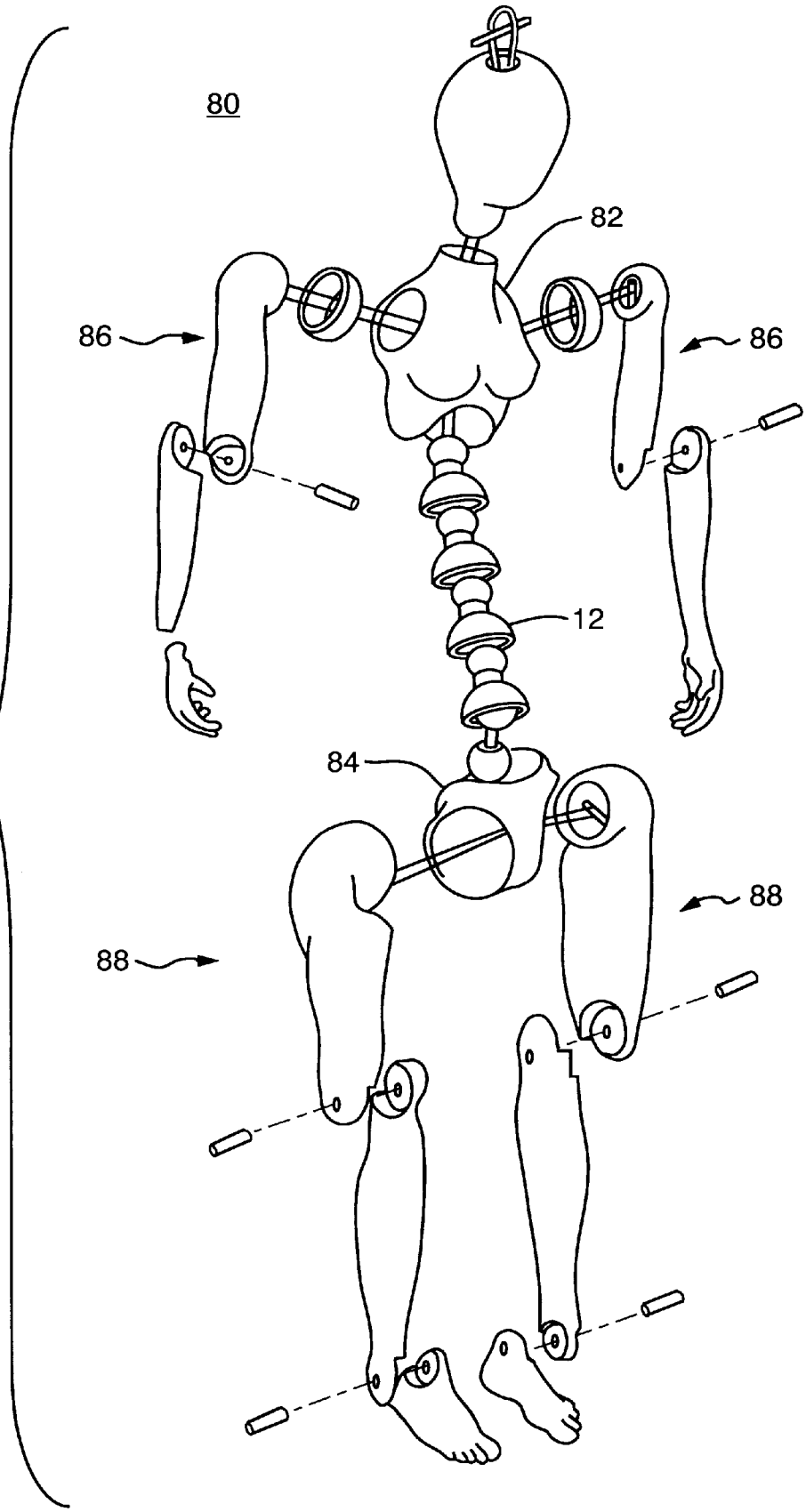
FIG. 5 is an exploded view of a poseable figure according to another embodiment of the present invention.

According to another embodiment, the spine system 12, FIG. 5, can be used in other types of poseable figures 80 that simulate the human form. An alternative embodiment of the first and second appendage connectors 82, 84 can be used to couple appendages 84, 86 to the spine system. The appendages 84, 86 in this embodiment can also be formed in multiple pieces with pivot joints or ball and socket joints, as described above.

Figure 6:
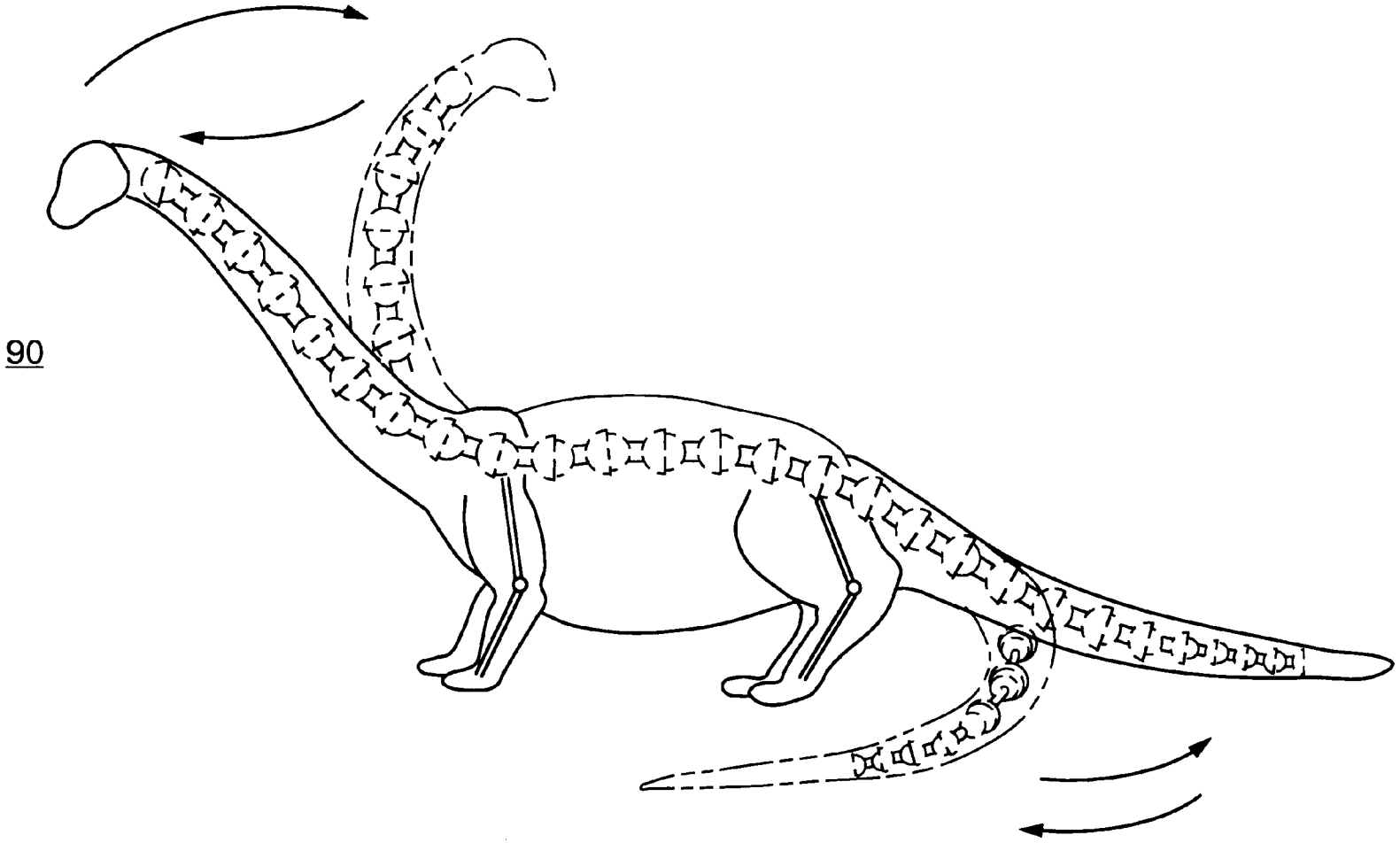
FIG. 6 is a perspective view of a poseable figure according to a further embodiment of the present invention.

The spine system 12, FIG. 6, can also be used in other types of poseable or articulated figures 90 that simulate animals or other living or non-living animated figures. These alternative embodiments can be constructed with or without appendage engaging members and/or ball and socket joints as described above.

Accordingly, the poseable figure having the spine system according to the present invention has a wide range of life-like movement and can be positioned and maintained in numerous lifelike poses. The improved ball and socket joints of the present invention covered by a soft body portion allow movement of the appendages of the poseable figure while holding the appendages in the desired position with no deterioration of integrity over time.

Modifications and substitutions by one of ordinary skill in the art are considered to be within the scope of the present invention which is not to be limited except by the claims which follow.

What is claimed is:

1. A poseable figure comprising:

a spine system having a first spine end and a second end, said spine system including a plurality of mating spine segments, wherein each of said plurality of mating spine segments are engaged, in a fraction fit, with an adjacent mating spine segment such that each of said plurality of mating spine segments swivel with respect to one another, wherein each of said plurality of mating spine segments includes:

a generally cup-shaped portion having an open concave receiving region and a closed rear wall; and a ball-shaped portion extending the rear wall of from said generally cup-shaped portion, wherein said ball-shaped portion of one of said plurality of mating spine segments is received in a concave receiving region of a mating one of said plurality of mating spine segments, and wherein said ball-shaped portion and said concave receiving region are dimensioned to provide said friction fit;

a soft body portion disposed around said spine system, said soft body portion simulating body flesh of said poseable figure, wherein said soft body portion is made of a low density foam having a density of about 2 to 6 lbs./ft$^3$ such that said friction fit between said mating spine segments counteracts the memory of said low density foam to allow various poses to be held;

a first appendage connector coupled to said spine system proximate said first spine end;

a first pair of appendages coupled to said first appendage connector such that said first pair of appendages swivel with respect to said first appendage connector;

a second appendage connector coupled to said spine system proximate said second spine end;

a second pair of appendages coupled to said second appendage connector such that said second pair of appendages swivel with respect to said second appendage connector; and a head coupled to said spine system at said first spine end.

2. The poseable figure of claim 1 further including an elastic member extending through said plurality of mating spine segments from said first spine end to said second spine end of said spine system.

3. The poseable figure of claim 2 further including a neck segment coupled to one of said plurality of mating spine segments at said first spine end, and wherein said head is coupled to said elastic member and engaged with said neck segment such that said head swivels with respect to said neck segment.

4. The poseable figure of claim 1 wherein said soft body portion is a made of a foam material.

5. The poseable figure of claim 1 further including a neck segment coupled to one of said plurality of mating spine segments at said first spine end, wherein said head is coupled to said neck segment.

6. The poseable figure of claim 1 wherein said first appendage connector includes:

a first pin extending through one of said plurality of mating spine segments at said first spine end of said spine system; and a first pair of ball-shaped appendage engaging members disposed at respective ends of said first pin, wherein each of said first pair of appendages includes a socket receiving one of said first pair of ball-shaped appendage engaging members.

7. The poseable figure of claim 6 wherein said first appendage connector further includes a sleeve insert disposed between each of said first pair of ball-shaped appendage engaging members and each respective said socket of said first pair of appendages, wherein each said sleeve insert applies pressure against each of said first pair of ball-shaped appendage engaging members to allow movement of a respective one of said first pair of appendages while maintaining a position of said respective one of said first pair of appendages.

8. The poseable figure of claim 7 wherein said sleeve insert is made of a silicone rubber material.

9. The poseable figure of claim 6 further including an elastic member extending through said plurality of mating spine segments from said first spine end to said second spine end of said spine system, and wherein said elastic member extends through said first pin.

10. The poseable figure of claim 9 wherein said second appendage connector includes:

a second pin extending through one of said plurality of mating spine segments at said second spine end of said spine system, wherein said elastic member extends through said second pin; and a second pair of ball-shaped appendage engaging members disposed at respective ends of said second pin, wherein each of said second pair of appendages includes a socket receiving one of said second pair of ball-shaped appendage engaging members.

11. The poseable figure of claim 1 wherein said plurality of mating spine segments include at least three mating spine segments.

12. The poseable figure of claim 1 wherein said poseable figure has a human form.

13. The poseable figure of claim 1 wherein said poseable figure has a non-human form.

14. The poseable figure of claim 1 wherein said soft body portion is made of a low density flexible water-blown polyurethane foam.

15. A poseable figure comprising:

a spine system having a first spine end and a second spine end, said spine system including a plurality of mating spine segments, each of said plurality of mating spine segments including a cup-shaped portion having a concave receiving region and a ball-shaped portion extending from said cup-shaped portion, wherein said ball-shaped portion of one of said plurality of mating spine segments is received, in a friction fit, in a concave receiving region of a mating one of said plurality of mating spine segments, and wherein each of said plurality of mating spine segments swivel with respect to a mating one of said plurality of mating spine segments;

a foam body portion disposed around said spine system;

at least a first pin coupled to said first spine end of said spine system;

a first pair of ball-shaped appendage engaging members disposed at respective ends of said first pin;

a first pair of appendages having sockets for receiving respective ones of said first pair of ball-shaped appendage engaging members;

a pressurized insert disposed between each of said first pair of ball-shaped appendage engaging members and said sockets of said first pair of appendages;

a second pin coupled to said second spine end of said spine system;

a second pair of ball-shaped appendage engaging members disposed at respective ends of said second pin;

a second pair of appendages having sockets for receiving respective ones of said second pair of ball-shaped appendage engaging members;

a pressurized insert disposed between each of said second pair of ball-shaped appendage engaging members and said sockets of said second pair of appendages;

wherein said pressurized inserts are made of a compressible material containing pressurized gas bubbles, wherein said compressible material is cured under pressure; and a resilient member extending through said plurality of mating spine segments and through said first and second pins.

16. The poseable figure of claim 15 wherein said compressible material is a silicone rubber material.

17. The poseable figure of claim 15 wherein said foam body has a density in a range of about 2 to 6 lbs./ft$^3$.

* * * * *